US009062915B2

(12) United States Patent
Smith

(10) Patent No.: US 9,062,915 B2
(45) Date of Patent: Jun. 23, 2015

(54) TOWER GRAIN DRYER

(76) Inventor: Steven G. Smith, Tiffin, OH (US)

( * ) Notice: Subject to any disclaimer, the term of this patent is extended or adjusted under 35 U.S.C. 154(b) by 854 days.

(21) Appl. No.: 13/313,118

(22) Filed: Dec. 7, 2011

(65) Prior Publication Data

US 2012/0311883 A1 Dec. 13, 2012

Related U.S. Application Data

(60) Provisional application No. 61/420,948, filed on Dec. 8, 2010.

(51) Int. Cl.

| | |
|---|---|
| ***F26B 7/00*** | (2006.01) |
| ***F26B 17/12*** | (2006.01) |
| *F26B 17/30* | (2006.01) |
| *F26B 25/00* | (2006.01) |

(52) U.S. Cl.

CPC ..... *F26B 17/124* (2013.01); *F26B 17/30* (2013.01); *F26B 25/00* (2013.01); *F26B 25/002* (2013.01); *F26B 2200/06* (2013.01)

(58) Field of Classification Search

CPC ..... F26B 17/30; F26B 17/124; F26B 25/00; F26B 25/002

USPC ..... 34/434, 436, 505, 167, 165; 460/8, 10, 460/56, 58, 118; 414/226.05, 331.05; 222/138–140

See application file for complete search history.

(56) References Cited

U.S. PATENT DOCUMENTS

| | | | | |
|---|---|---|---|---|
| 211,432 | A | 1/1879 | Roberts et al. | |
| 2,591,173 | A | 4/1952 | Marken | |
| 3,088,881 | A * | 5/1963 | Chevalier | 435/291.3 |
| 4,896,615 | A * | 1/1990 | Hood et al. | 111/177 |
| 5,020,246 | A | 6/1991 | Rust et al. | |
| 5,625,443 | A * | 4/1997 | Ohta et al. | 399/353 |
| 6,035,544 | A | 3/2000 | Morrison et al. | |
| 6,336,239 | B1 * | 1/2002 | Cooper | 15/56 |
| 6,390,461 | B1 * | 5/2002 | Vitko et al. | 271/99 |
| 6,499,930 | B1 * | 12/2002 | Dixon | 414/313 |
| 2010/0145529 | A1 * | 6/2010 | Thomason et al. | 700/283 |
| 2012/0036731 | A1 * | 2/2012 | Abyhammar | 34/147 |

OTHER PUBLICATIONS

"Commercial Tower Dryers", Brock Grain Systems, www.graindryers.com.

"T-Series Tower Drying", GSI.

"10' Diameter Vacuum Cool Tower Dryers", Mathews Company.

* cited by examiner

*Primary Examiner* — Kenneth Rinehart

*Assistant Examiner* — John McCormack

(74) *Attorney, Agent, or Firm* — MacMillan, Sobanski & Todd, LLC

(57) ABSTRACT

A rotatable grain tower mounted on a stationary base. The base includes an opening for the removal of grain from a grain plenum in the tower. As the tower is rotated, a metering device adjacent the opening meters the rate of grain exiting the plenum. The rotating tower alleviates uneven drying due to sun, wind and other conditions to more evenly dry grain in the plenum. A cleaning device may be positioned adjacent the tower to clean the plenum as the tower rotates, thereby eliminating catwalks and other expensive equipment and devices used for cleaning stationary towers.

20 Claims, 8 Drawing Sheets

TOWER GRAIN DRYER

CROSS-REFERENCE TO RELATED APPLICATION

This application claims the benefit of U.S. Provisional Application No. 61/420,948 filed Dec. 8, 2010, the disclosure of which is incorporated herein by reference.

FIELD OF THE INVENTION

This invention relates to grain dryers in general and more particularly to tower or vertical grain dryers.

BACKGROUND OF THE INVENTION

In many instances, agricultural grain products must be stored for an extended period of time prior to being used. However, prior to storage, it is necessary to dry the grain to a condition in which it is less subject to molding or other deterioration. Accordingly, it has become known to remove moisture from grain by passing the grain through a grain dryer prior to storage.

Tower grain dryers are well known. Generally, they comprise a vertical tower having a cylindrical shape with an annular grain plenum. The outer wall of the plenum is generally cylindrical. An inner cylindrical wall coaxial with the outer wall is spaced inwardly from the outer wall. Generally, the inner cylindrical wall has a diameter of about two feet less than the outer wall, resulting in an annular plenum between the walls having a thickness of about 12 inches. The plenum provides a vertical grain path between the two walls. The walls are constructed from perforated stainless steel screens to be porous such that heated air from within the plenum may be forced through the walls and through the grain in the plenum.

A typical annular plenum is divided into a series of vertical columns by dividers which are circumferentially spaced one to two feet apart in the plenum. Grain loaded in the top of the tower descends under force of gravity thought the vertical columns in the plenum.

As heated air moves through the grain, moisture is removed. Dried grain is continuously discharged from the lower end of the plenum. Additional grain to be dried is loaded into the upper end of the drying path.

To control the amount of moisture removed from the grain, it is necessary to precisely control the flow rate of the grain through the grain columns of the plenum. Grain in the grain columns exposed to heated air for an extended period of time may become too dry. Grain that passes quickly through the grain columns may retain an undesirable amount of moisture.

Heated air is supplied to the grain by means of one or more burner/blower assemblies. Heated air is forced from within the radially inner wall of the plenum through the plenum's porous or perforated inner wall, through the grain in the drying paths, and finally through the porous outer plenum wall, carrying away moisture from the grain.

Expensive and elaborate sweep systems have been developed to remove grain from drying towers. Sweep systems are located at the bottom of the plenum and remove grain from the bottom of the grain columns when dried to a desired moisture content. As is well known, sensors in the grain tower determine the moisture content of the grain and signal the grain removal system, typically a sweep system, to remove certain amounts of grain from the bottom of the vertical columns. However, for various reasons, grain descending through the various columns does not dry at the same rate, with some grain being over dried and some grain being under dried.

Currently available grain dryers can be inefficient for several reasons. The primary source of inefficiency is imprecise drying due to uneven drying among the various vertical grain paths. This can result from various factors, such as wind and sun affecting some vertical grain columns more than others. Sweep systems at the bottom of a typical grain dryer sweep grain generally evenly from the adjacent columns even though grain in adjacent columns may have different moisture content.

Another possible source of inefficiency is that the perforated plenum walls or screens often clog from the grain or grain shells, etc. To maintain dryer efficiency, it is necessary to clean the screens periodically. Typically this is done manually. Large grain towers typically have catwalks vertically spaced approximately every 10 feet for this purpose. Catwalks add capital cost to the dryers, and manual cleaning adds operating or maintenance costs. Frequent cleaning of the plenum is necessary for maximum efficiency. Unfortunately, because of the high cost of cleaning, grain towers are not always operated at maximum efficiency.

What is needed is a grain tower which more efficiently dries grain and which can be less expensively manufactured and maintained.

SUMMARY OF THE INVENTION

The present invention is a rotatable grain tower mounted on a stationary base. The base includes an opening for the removal of grain from the grain plenum. As the tower is rotated, a metering device adjacent the opening meters the rate of grain exiting the plenum. The rotating tower alleviates uneven drying due to sun, wind and other conditions to more evenly dry grain in the plenum. A cleaning device may be positioned adjacent the tower to clean the plenum as the tower rotates, thereby eliminating catwalks and other expensive equipment and devices used for cleaning stationary towers.

Various other aspects of this invention will become apparent to those skilled in the art from the following detailed description of the preferred embodiment, when read in light of the accompanying drawings.

DETAILED DESCRIPTION OF PREFERRED EMBODIMENTS

Figure 1:
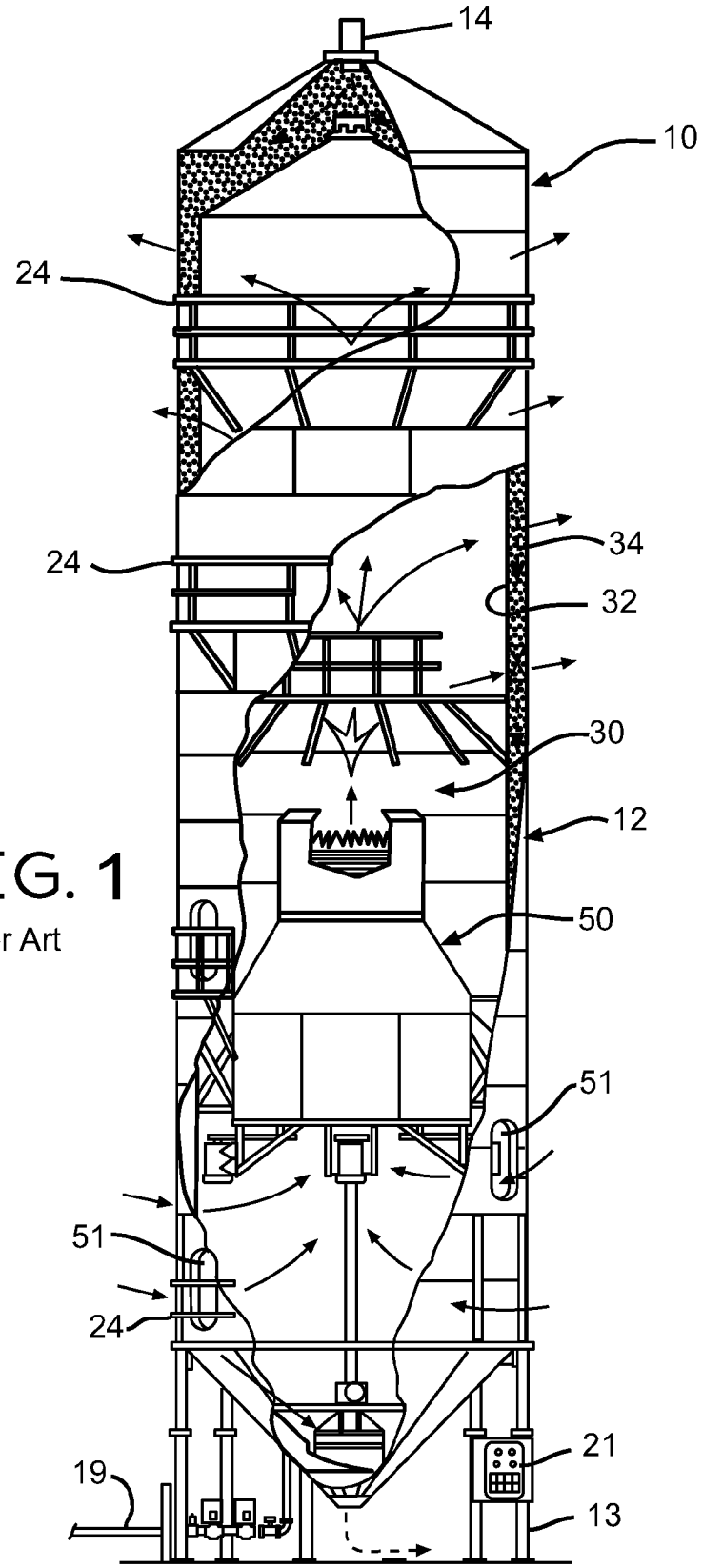
FIG. 1 Prior Art
FIG. 1 is a partially cut away view of a conventional prior art tower grain dryer.

FIG. 1 shows a conventional vertical grain dryer 10. The dryer includes a vertical grain drying tower 12 which, for example, may be fifty feet or more in height. The tower has a base 13 of suitable structural steel members mounted in a suitable foundation (not shown). The grain dryer includes a plenum 30 defined by a generally cylindrical porous inner plenum wall 32. An outer cylindrical wall 34 of porous construction surrounds plenum wall 32 and is coaxially spaced outwardly therefrom so as to define a vertical, annular grain drying path. Radial spacing between porous walls is generally 11-13 inches and is typically about 12 inches. Grain is supplied to grain drying path by means of a grain inlet 14 at the top of tower.

A heater/blower assembly 50 is provided within the grain dryer. The assembly 50 draws ambient air through closable windows 51 and through the grain path in the lower portions of the tower. The assembly 50 heats air within the tower and discharges the heated air under pressure through the plenum 30. In this manner, the air discharged from the heater/blower 50 is distributed substantially uniformly within the plenum. Heated air is forced to flow through the porous plenum wall 32, through the grain in grain drying path, and through the porous outer plenum wall 34, thereby drying the grain in the grain path and carrying moisture from the grain to the atmosphere.

The heater/blower 50 may be located outside the tower in close proximity thereto, with heated air from the heater/blower ducted into the tower Typically, fuel and electricity for the heater/blower assembly 50 is supplied by electrical and gas fuel supply lines 19. Operation of the heater/blower assembly and overall operation of tower dryer is controlled by a computer control housed in a control panel 21. Typical prior art tower dryers have multiple catwalks 24 to facilitate cleaning of the tower.

Figure 2:
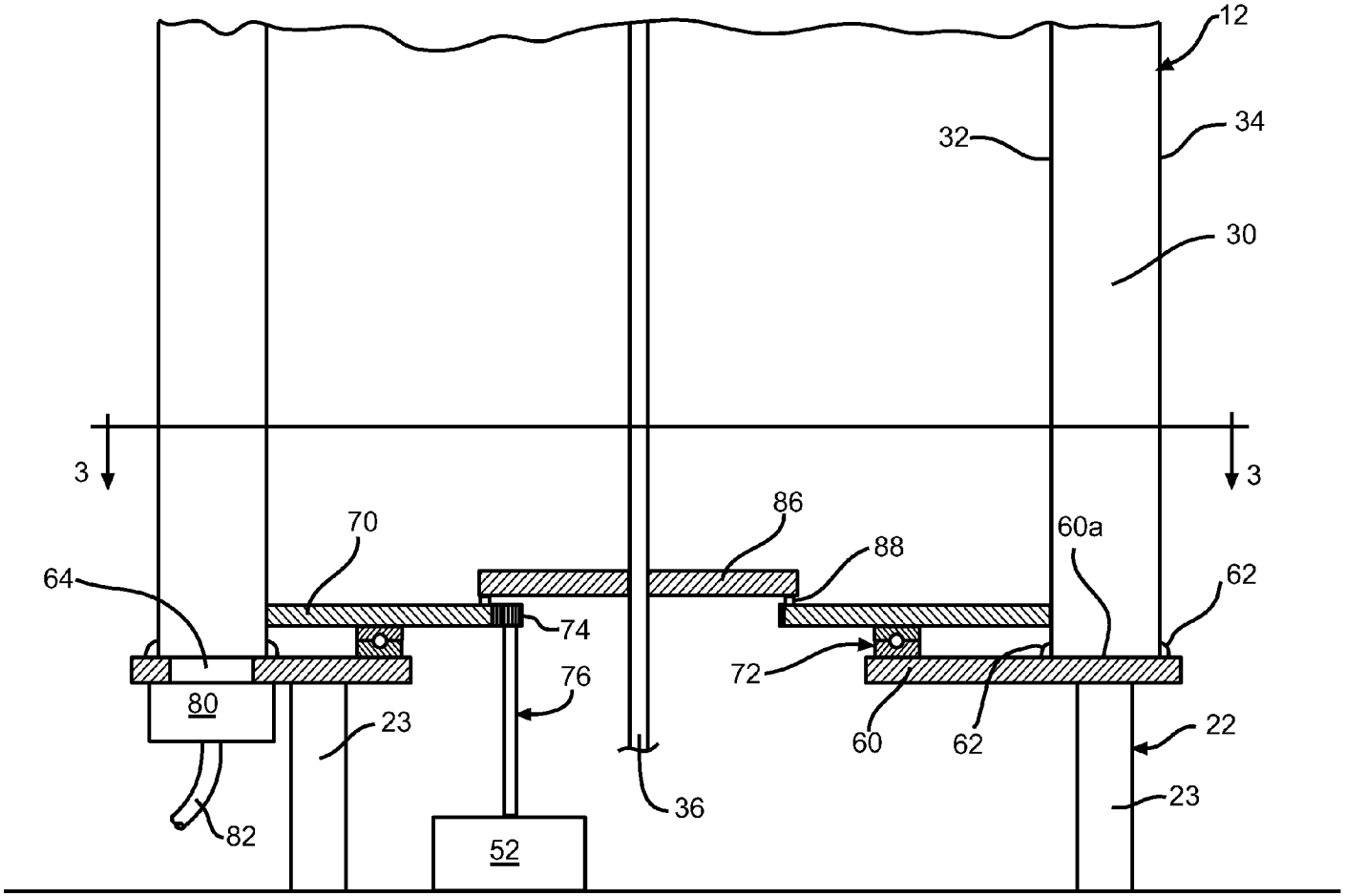
FIG. 2 is a cross-sectional view of the bottom portion of a grain dryer of the present invention.

FIG. 2 shows a grain tower of the present invention. The upper portion of the grain tower of the present invention is substantially the same as the prior art tower 10. A base 22 is formed by a series of circumferentially spaced supports 23, such as steel beams or posts which may be anchored in a concrete pad (not shown). The base includes an annular outer plate 60 rigidly affixed to the support posts 23. The top surface 60*a* of the outer plate 60 under the plenum 30 is coated with a low friction coating such as Teflon, nylon or a high density plastic coating so that grain may easily be dragged along the plate when the tower is rotated as will be described herein. The outer plate includes a grain discharge opening 64.

The tower 12 includes inner and outer plenum walls 32, 34 defining a grain plenum 30. The plenum walls are rigidly affixed to an inner annular plate 70 as will be described herein. The inner plate 70 is mounted for rotation on the outer plate 60 by a swing bearing 72 which can be sourced from Timken, PSL, etc. The bearing may be a tapered roller bearing, but a tapered bearing is generally not required for a tower of typical height because the bearing does not need to carry significant lateral forces. The only significant lateral force is the force of wind on the tower. Seals 62 attached to either the outer plate 60 or the plenum walls 32, 34 are used to seal the bottom of the plenum to the outer plate as the tower rotates relative to the outer plate.

A louver system 86 is rigidly mounted on the inner plate 70 with bolts 88. Alternatively, the louver system may be mounted for rotation on the inner plate 70 with bearings. A conduit 36 is provided through the louver system to supply electrical power and fuel to the heater/blower. The louver system 80 eliminates the need for the air doors 51 (FIG. 1) of prior art towers.

An electric motor 52 is operationally connected to the tower though a drive train 76. A gear 74 engages gear teeth on the inner plate 70 to slowly rotate the inner plate, causing the tower to rotate.

Figure 3:
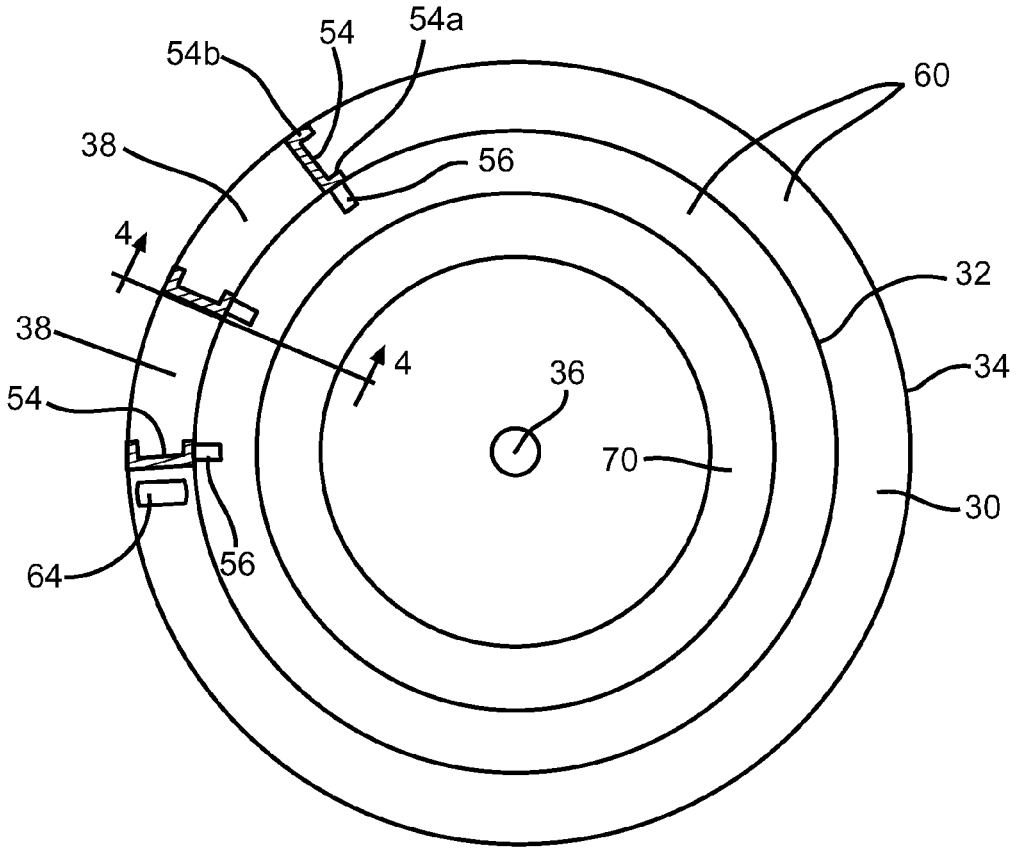
FIG. 3 is a cross sectional top view of the grain dryer of FIG. 2 taken along line 3-3 of FIG. 2.

Referring to FIG. 3, the grain path is divided into vertical grain channels by vertically extending pairs of channels 54 (only three shown in FIG. 3) having inner and outer flanges 54*a*, 54*b* secured to the inner and outer plenum walls 32, 34, respectively, by welding, bolting, etc. Depending on the diameter of the tower 12, the grain path may be divided into about 12-20 of such grain channels (only two shown in FIG. 3).

Figure 4:
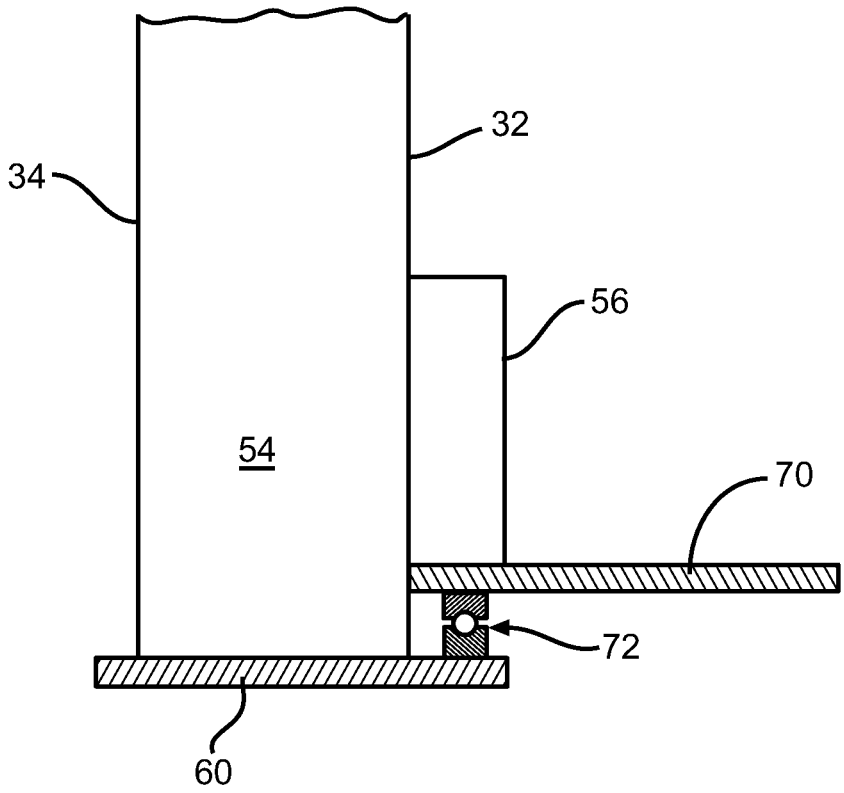
FIG. 4 is a cross-sectional view of the grain dryer of FIG. 2 taken along line 4-4 of FIG. 3.

Referring to FIGS. 3 and 4, the tower is mounted to the inner plate 70 by means of supports 56. The supports are rigidly connected to the inner plate 70 by bolts, welding or the like. The supports are rigidly connected to the inner and outer plenum walls through channels 54 by welding, bolting or the like.

Referring again to FIG. 1, a metering device 80 is attached to the underside of the outer plate 60 underneath the grain discharge outlet 64. Dried grain from the metering device can be transported to storage through conduit 82. Preferably the metering device is an airlock metering roll which can be used not only to meter the rate of grain discharge, but also to form part of an airtight system to pneumatically transport the dried grain to storage through conduit 82.

In operation, grain fed through the top of the tower 14 moves vertically downwardly under gravitation force through the plenum 30. The tower is rotated by motor 52 at the rate of about one to two (1-2) rpm around a central vertical axis of rotation. Tower rotation alleviates hot spots in the grain caused by uneven exposure of one side of the tower to sun, wind, rain and other elements. Sensors in the grain tower determine the moisture content of the grain and automatically allow the optimum amount of grain to be removed from each vertical column as it passes over the grain discharge opening 64. This system better accommodates uneven grain moisture in adjacent columns than widely used sweep systems. Better metering stops over drying, thereby adding efficiency and increasing capacity tower dryers.

Figure 5:
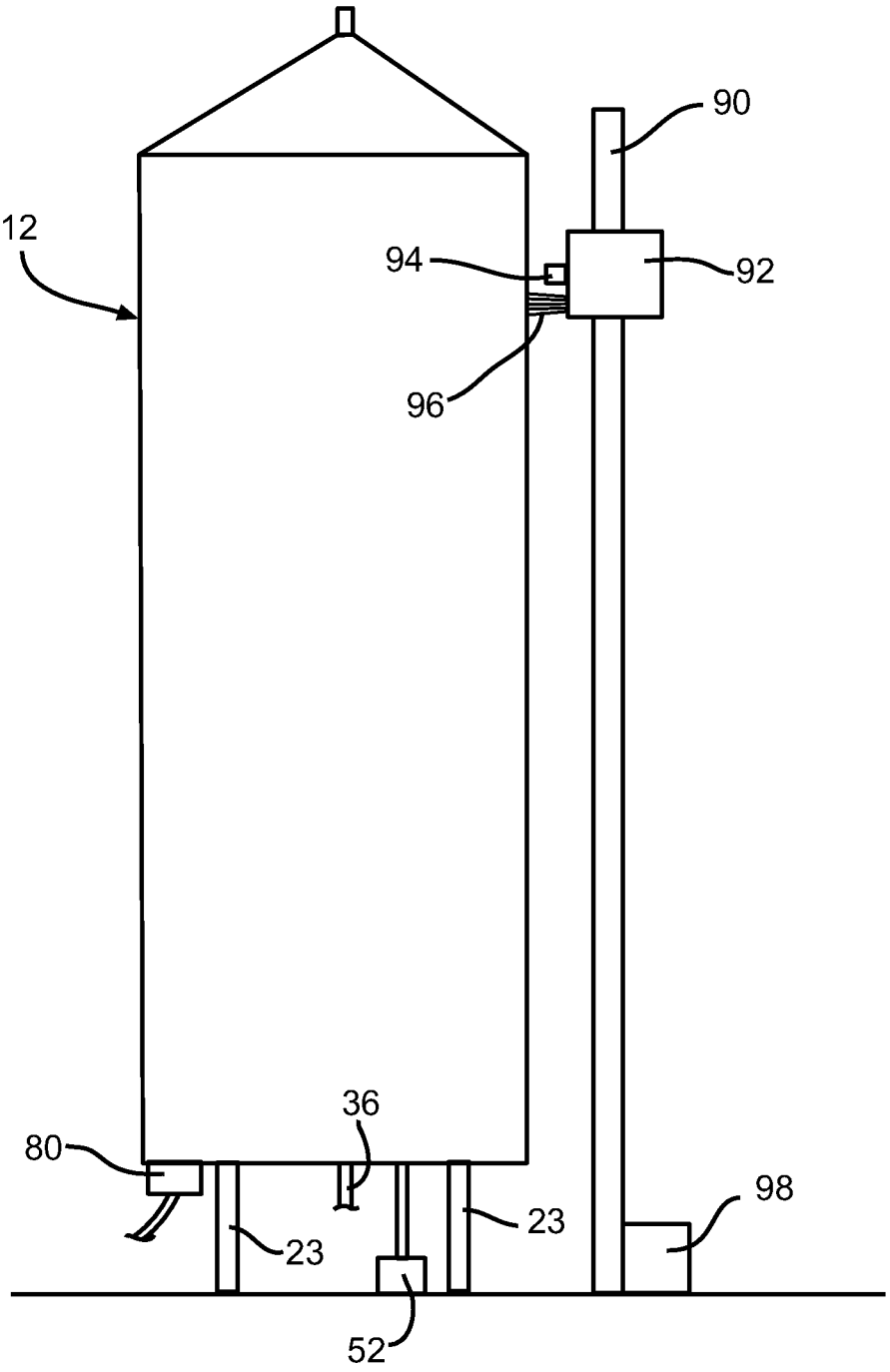
FIG. 5 is a schematic view of the grain dryer of FIG. 2 including a cleaning device.

FIG. 5 shows a cleaning system for use with the rotatable tower. A cleaning device 92 having a nozzle 94 is movably mounted on a cleaning tower 90 such as a pole or truss adjacent the tower. The cleaning device may include a pressurized fluid ejection devices such as blowers and power washers to clean the outer plenum wall 34 with pressurized air or water or other fluids. In addition, the cleaning device 92 may include retractable brushes 96 which may selectively engage the outer plenum wall 34.

Cleaning device 92 may be raised and lowered along the tower 90 using any typical method, such as a ball screw actuator 98. Cleaning device 92 can be positioned at various vertical positions in discreet timed steps, or the device 92 can be vertically moved continuously as the tower turns, either automatically or manually. The outer plenum wall 34 can thereby be cleaned while the tower slowly rotates. The rotatable tower allows the elimination of expensive catwalks used for this and other purposes.

Figure 6:
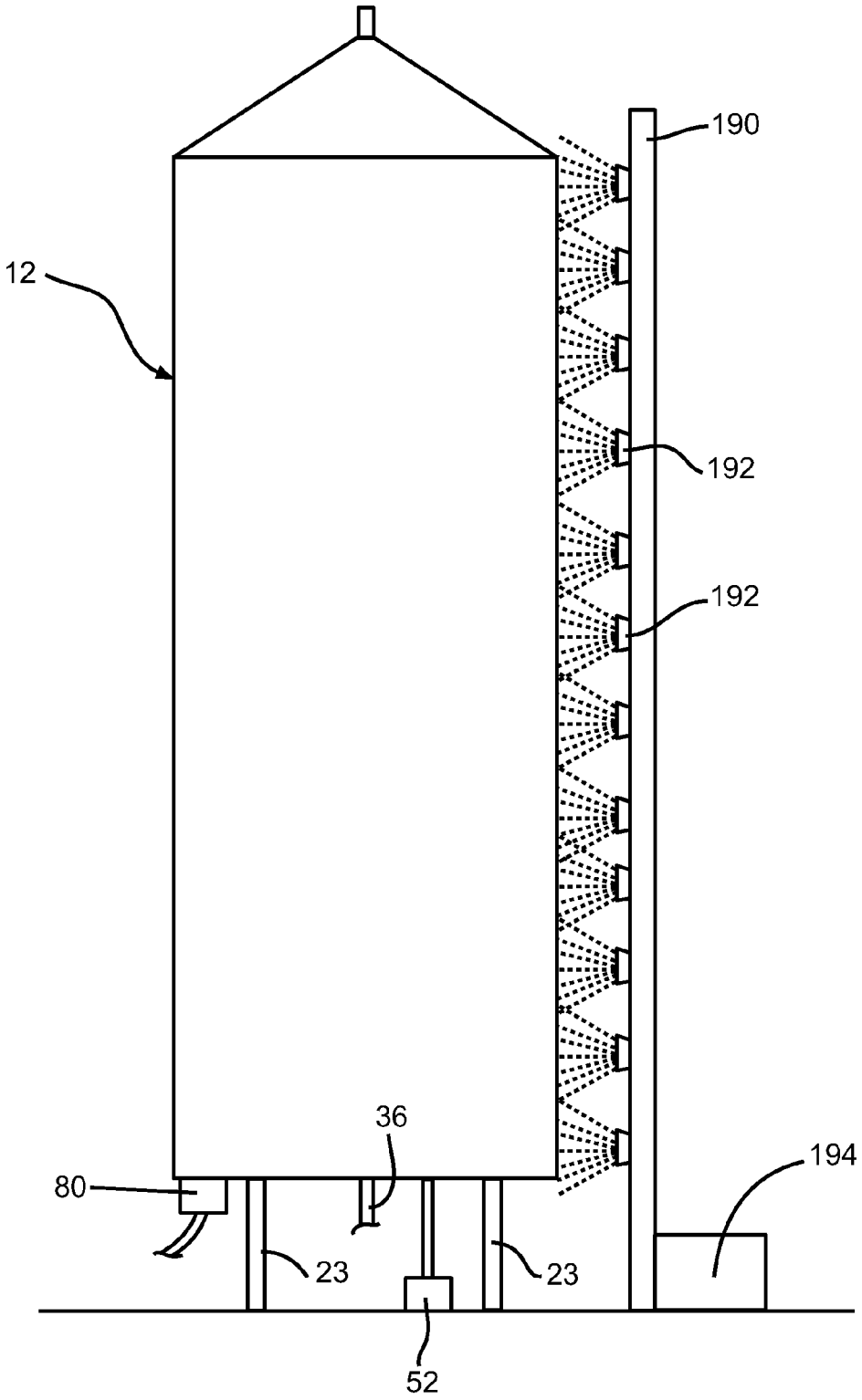
FIG. 6 is a schematic view of the grain dryer of FIG. 2 including an alternative cleaning device.

FIG. 6 shows an alternative cleaning tower 190 which includes a series of fixed nozzles 192 vertically spaced throughout the entire length of the tower 90. A fluid pressure system 194 provides pressurized fluid through the nozzles 192, which may selectively discharge pressurized air or fluid over the entire vertical length of the plenum. Retractable brushes (not shown) may also be positioned along the entire length of the tower 190 in addition to or in place of the pressurized fluid system. With this arrangement, cleaning tower 190 can be used to clean the entire plenum with one revolution of the tower 10. Of course, several revolutions of the tower may be necessary for a more thorough cleaning.

It will be readily understood that the cleaning systems described above will be less costly to install than catwalks necessary in currently used towers, and less costly to use than manual cleaning procedures currently used. Because of the reduced cost and automated use, a tower plenum can be cleaned more frequently, even continuously if desired, to maintain maximum efficiency.

Figure 7:
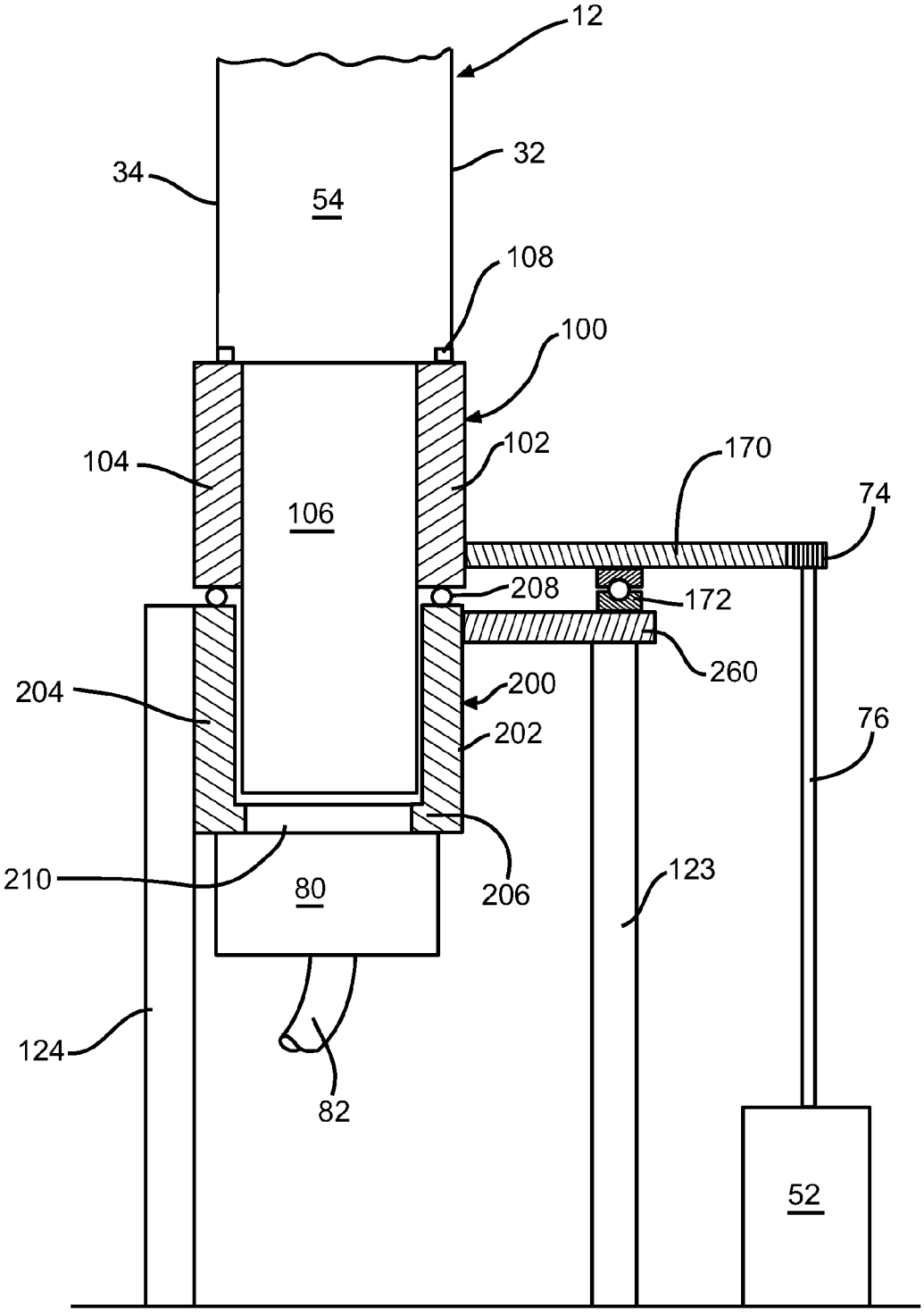
FIG. 7 is a cross-sectional view of a bottom portion of an alternative embodiment of the grain dryer of the present invention.
Figure 8:
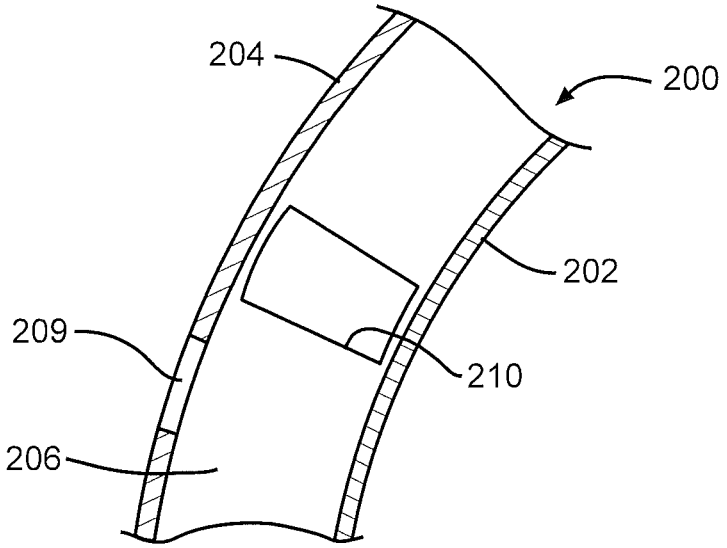
FIG. 8 is a top plan view of a component of the alternative embodiment of FIG. 7.

FIGS. 7 shows an alternative embodiment in which the tower 12 is rigidly mounted on an annular grain drag 100. The grain drag 100 has an annular inner wall 102 and annular outer wall 104 which are rigidly connected by a series of drag plates 106 which are welded to the walls. The drag plates 106 extend into a grain pan as will be described. The tower screens 32, 34 are mounted on top of the annular walls 102, 104, respectively, for rotation therewith. Although not essential, the number of drag plates 106 is the same as the number of vertical tower channels 54, and the drag plates are aligned with the vertical channels 54. Annular seals 108 may be used at the interface of the grain drag and tower screens to assure a sealed connection.

An annular grain pan 200 is positioned under the grain drag 100. The grain pan has inner 202 and outer 204 annular walls generally vertically aligned with the grain drag walls 102, 104, respectively. Annular seals 208 allow rotation of the grain drag 100 relative to the grain pan 200. Annular grain pan bottom wall 206 is coated with a smooth plastic or comparable surface to allow easy dragging of grain. The pan bottom 206 includes one or more grain discharge openings 210. If the grain pan has more than one discharge opening 210, it is preferred that they are equally circumferentially spaced around the grain bottom 206.

The drag plates 106 are dimensioned to closely fit within the grain pan 200. It is possible to coat the inside surfaces of the grain pan walls 202, 204 with a smooth plastic or comparable coating to facilitate grain movement and any contacting of these surfaces by the drag plates 106. Alternately, the edges of the drag plates 106 may be similarly coated.

Outer grain pan wall 204 may include removable sections 209 for accessing the inside surface of the grain pan 200. For example, a section could be removed and a brush could be inserted to clean the grain pan surface as it is pushed around the grain pan by the drag plates 106. The removable sections 209 may also be used to access the grain pan for replacement of a plastic or other low friction surface coating on the inside surface of the grain pan.

Grain pan 200 is rigidly attached to a radially inwardly extending annular support plate 260 by welding. Support plate 260 is rigidly supported by posts or pillars 123. Support posts or pillars 124 positioned radially outwardly of the grain pan 200 may be used instead of or in addition to supports 123. In either case, the supports rigidly support the grain pan 200 in a stationary position.

Grain drag 100 is rigidly attached to an annular grain drag support plate 170 by welding. The grain drag 100 is supported on a bearing 172 through the support plate 170. Bearing 172 is in turn supported for rotation on grain pan support plate 260. As in the prior embodiments, a motor 52 connected by a drive train 76 operates a set of gears 74 to rotate the grain drag 100.

A metering device 80 is connected to the grain pan 200 below each grain discharge opening 210. As the tower and grain drag 100 rotate, drag plates 106 carry grain over openings 210. Metering devices 80, controlled by computers being fed with input from the sensors, remove the appropriate amount of grain.

Referring to FIG. 7, the shape of the grain discharge openings 210 can be fine tuned. For example, the openings can be round or square, but preferably are generally quadrilateral shaped, having curved radially inner and outer boundaries and radially extending circumferential boundaries to more closely pattern the volume of the plenum above the openings across its radial width.

The principle and mode of operation of this invention have been explained and illustrated in its preferred embodiments. However, this invention may be practiced otherwise than as specifically explained and illustrated without departing from its spirit or scope as defined by the appended claims.

What is claimed is:

1. A vertically extending grain tower comprising:

an annular grain plenum comprising a vertically extending inner plenum wall and a vertically extending outer plenum wall, the inner plenum wall rigidly rotationally affixed relative to the outer plenum wall, a fixed base including an annular grain pan positioned under the grain plenum, the grain pan having a metering hole, and a motor for rotating the tower.

2. A grain tower as defined in claim 1 wherein the lower end of the plenum is generally open.

3. A grain tower as defined in claim 2 further comprising a metering device adjacent the metering hole.

4. A grain tower as defined in claim 3 wherein the metering device is an airlock metering roll fixed to the grain pan.

5. A grain tower as defined in claim 1 further comprising an annular grain drag affixed to the tower and generally covering the lower end of the plenum, the grain drag comprising a drag plate extending into the grain pan, whereby material within the grain pan is dragged by the grain drag as the tower rotates.

6. A grain tower as defined in claim 1 wherein the grain pan surface includes a coating.

7. A grain tower as defined in claim 1 wherein the grain pan has a radially outer wall including a removable portion.

8. An apparatus comprising a grain tower, the grain tower comprising a vertically extending inner plenum wall and a vertically extending outer plenum wall, the inner plenum wall rigidly rotationally affixed relative to the outer plenum wall, the inner and outer plenum walls defining a vertically extending grain plenum therebetween, grain tower having a vertical axis of rotation, and a motor operatively connected to the grain tower for rotating the grain tower around the vertical axis of rotation.

9. An apparatus as defined in claim 8 wherein the inner plenum wall and the outer plenum wall are porous, cylindrical, and generally concentric about the vertical axis, whereby the grain tower comprises a generally annular grain plenum.

10. An apparatus as defined in claim 8 further comprising a fixed base, wherein the grain tower is supported for rotation on the fixed base.

11. An apparatus as defined in claim 10 wherein the lower end of the plenum is generally open, and wherein the fixed base includes an annular support plate which generally covers the lower end of the plenum.

12. An apparatus as defined in claim 11 wherein the support plate comprises a metering hole under the plenum.

13. An apparatus as defined in claim 12 further comprising a metering device adjacent the metering hole.

14. An apparatus as defined in claim 12 wherein the support plate surface includes a coating.

15. An apparatus as defined in claim 13 wherein the support plate further comprises a second metering hole under the plenum, the second metering hole circumferentially spaced from the metering hole, the apparatus further comprising a second metering device adjacent the second metering hole.

16. An apparatus as defined in claim 8 further comprising a vertically extending cleaning tower adjacent the grain tower, the cleaning tower extending approximately the full vertical length of the outer plenum wall.

17. An apparatus as defined in claim 16 wherein the cleaning tower comprises a fluid ejection device.

18. An apparatus as defined in claim 16 wherein the cleaning tower comprises a brush configured to selectively engage the radially outer surface of the outer plenum wall.

19. An apparatus as defined in claim 17 wherein the cleaning tower comprises a vertically extending support and a cleaning device moveable vertically along the support.

20. An apparatus as defined in claim 18 wherein the cleaning tower comprises a vertically extending support and a cleaning device moveable vertically along the support.

* * * * *